US009460673B2

(12) United States Patent
Zhu et al.

(10) Patent No.: US 9,460,673 B2
(45) Date of Patent: Oct. 4, 2016

(54) LCD PANEL HAVING OVERVOLTAGE DRIVING TABLE AND METHOD FOR DRIVING THE LCD PANEL

(71) Applicant: SHENZHEN CHINA STAR OPTOELECTRONICS TECHNOLOGY CO., LTD, Shenzhen (CN)

(72) Inventors: Jiang Zhu, Shenzhen (CN); Zuomin Liao, Shenzhen (CN); Bing Hab, Shenzhen (CN)

( * ) Notice: Subject to any disclaimer, the term of this patent is extended or adjusted under 35 U.S.C. 154(b) by 227 days.

(21) Appl. No.: 14/117,629

(22) PCT Filed: Aug. 1, 2013

(86) PCT No.: PCT/CN2013/080617

§ 371 (c)(1),
(2) Date: Nov. 14, 2013

(87) PCT Pub. No.: WO2015/013952

PCT Pub. Date: Feb. 5, 2012

(65) Prior Publication Data

US 2015/0035878 A1 Feb. 5, 2015

(30) Foreign Application Priority Data

Jul. 30, 2013 (CN) ..... 2013 1 0325387

(51) Int. Cl.
*G09G 3/36* (2006.01)

(52) U.S. Cl.
CPC ..... *G09G 3/3648* (2013.01); *G09G 3/3607* (2013.01); *G09G 2320/0242* (2013.01); *G09G 2320/0252* (2013.01); *G09G 2320/0285* (2013.01)

(58) Field of Classification Search
CPC ..... G09G 3/3607; G09G 3/3648
USPC ..... 345/89
See application file for complete search history.

(56) References Cited

U.S. PATENT DOCUMENTS 7,804,474 B2 * 9/2010 Chen ..... G09G 3/3648 345/89
2006/0158416 A1 7/2006 Ku
(Continued)

FOREIGN PATENT DOCUMENTS

CN 101325046 A 12/2008
CN 102136237 A 7/2011

OTHER PUBLICATIONS

Li Wenfei, the International Searching Authority written comments, May 2014, CN.

*Primary Examiner* — Chanh Nguyen
*Assistant Examiner* — Daniel Duong

(57) ABSTRACT

A liquid crystal display (LCD) panel includes a plurality of pixels, scan lines, data lines crisscrossing with the scan lines, a data driving unit that drives the data lines, an overvoltage driving unit coupled to the data driving unit, a data analysis unit coupled to the overvoltage driving unit and reading gray level of each of sub-pixels, an original overvoltage driving table, and a first overvoltage driving table. Each of the pixels belonging to a same column receives data of a same data line, and each of the pixels includes three sub-pixels controlled by three adjacent scan lines one by one. The original overvoltage driving table and the first overvoltage driving table are coupled to the data analysis unit. When an input signal driving the first overvoltage driving table is same as an input signal driving the original overvoltage driving table, partial voltages driving the data lines and corresponding to the first overvoltage driving table is greater than voltage driving the data lines and corresponding to the original overvoltage driving table. In a same frame image, when gray level of a current sub-pixel is greater than gray level of a previous sub-pixel of a same data line with the current sub-pixel, and gray level difference between the two sub-pixels is greater than a first threshold value, the overvoltage driving unit drives the current sub-pixel according to the first overvoltage driving table.

1 Claim, 5 Drawing Sheets

(56) References Cited

U.S. PATENT DOCUMENTS

2007/0290964 A1 12/2007 Yang
2009/0085856 A1* 4/2009 Okada ..... G09G 3/3648 345/94
2012/0120044 A1* 5/2012 Mizunaga ..... G09G 3/3614 345/211
2014/0104262 A1* 4/2014 Miyake ..... G09G 3/3696 345/212
2014/0168183 A1* 6/2014 Yang ..... G09G 3/3614 345/209

* cited by examiner

LCD PANEL HAVING OVERVOLTAGE DRIVING TABLE AND METHOD FOR DRIVING THE LCD PANEL

TECHNICAL FIELD

The present disclosure relates to the field of liquid crystal displays (LCDs), and more particularly to an LCD panel and a method for driving the LCD panel.

BACKGROUND

A liquid crystal display (LCD) panel includes a plurality of thin film transistors (TFTs), scan lines, and data lines. The data lines and the scan lines crisscross each other. One scan line controls gate electrodes of one corresponding row of TFTs, one data line controls source electrodes of one corresponding column of TFTs, and a drain electrode of each of the TFTs is connected with a pixel capacitor. The scan lines are connected with a scan chip, and the data lines are connected with a data driving unit, where the scan chip successively outputs a driving signal of each of the scan lines through scanning one by one, and the data lines output data signals of the TFTs correspond to each of the scan lines.

A line is arranged to transfer a signal output by the data driving unit to the data lines, as a number of output channels of the data driving unit increases, length of the lines of two sides of the data driving unit correspondingly increases and impedance of the lines of two sides of the data driving unit correspondingly increases. Degree of delay of the data signal is dependent on impedance value of the line, as the impedance value of the line increases, the degree of the delay of the data signal increases. The delay of the data signal causes undercharge of a pixel. More particularly, when the pixel is changed from gray level zero to a new gray level, a voltage change of a pixel electrode becomes slow and the charge of the pixel sharply reduces because of the delay of the data signal, which seriously affects the gray level of the pixel. In a driving method of a column inversion or a frame inversion, an obvious color shift is generated in an image of two-color mixing.

SUMMARY

In view of the above-described problems, the aim of the present disclosure is to provide a liquid crystal display (LCD) panel and a method for driving the LCD panel capable of reducing a color shift.

The aim of the present disclosure is achieved by the following methods.

The LCD panel comprises a plurality of pixels, scan lines, data lines, and a data driving unit that drives the data lines. The data lines and the scan lines crisscross each other. Each of the pixels belonging to a same column receives data of a same data line, and each of the pixels comprises three sub-pixels controlled by three adjacent scan lines one by one. The LCD panel further comprises an overvoltage driving unit coupled to the data driving unit, a data analysis unit coupled to the overvoltage driving unit and reading gray level of each of the sub-pixels, an original overvoltage driving table, and a first overvoltage driving table, where the original overvoltage driving table and the first overvoltage driving table are coupled to the data analysis unit. When an input signal driving the first overvoltage driving table is same as an input signal driving the original overvoltage driving table, partial voltages driving the data lines and corresponding to the first overvoltage driving table are greater than voltage driving the data lines and corresponding to the original overvoltage driving table. In a same frame image, when gray level of a current sub-pixel is greater than gray level of a previous sub-pixel of a same data line with the current sub-pixel, and gray level difference between the current sub-pixel and the previous sub-pixel is greater than a first threshold value, the overvoltage driving unit drives the current sub-pixel according to the first overvoltage driving table.

Furthermore, the LCD panel further comprises a second overvoltage driving table coupled to the data analysis unit. When an input signal driving the second overvoltage driving table is same as the input signal driving the original overvoltage driving table, partial voltages driving the data lines and corresponding to the second overvoltage driving table is less than the voltage of driving the data lines and corresponding to the original overvoltage driving table. In the same frame image, when gray level difference between the current sub-pixel and the previous sub-pixel of the same data line with the current sub-pixel is less than a second threshold value; the overvoltage driving unit drives the current sub-pixel according to the second overvoltage driving table. The sub-pixel having great gray level receives the corresponding great driving voltage, when a next sub-pixel of the same data line with the sub-pixel having the great gray level is display, in order to avoid the corresponding great driving voltage from causing over charging of the next sub-pixel of the same data line, the LCD panel uses the second overvoltage driving table having a smaller voltage than the original overvoltage driving table, which reduces charge difference between adjacent sub-pixels having the great gray level, thereby reducing the color shift.

Furthermore, a range of the second threshold value is between a quarter of full gray scale and zero. At this time, pixel voltage difference between two adjacent sub-pixels is maximum, which reduces the color shift.

Furthermore, a range of the first threshold value is between three-fourths full gray scale and the full gray scale. The current sub-pixel is driven according to the first overvoltage driving table, when the gray level of the next sub-pixel is closely to the pay level of the current sub-pixel, if the next sub-pixel is driven according to the first overvoltage driving table, over charge of the next sub-pixel is easily caused. Thus, the next sub-pixel is driven according to the second overvoltage driving table having smaller voltage than the original overvoltage driving table, which reduces charge of the next sub-pixel, and reduces charge different between two sub-pixels, thereby reducing the color shift.

Furthermore, the LCD panel comprises a frame buffer unit, a timing control chip, and a storage unit, where the gray level of each of the sub-pixels is stored in the frame buffer unit. The original overvoltage driving table, the first overvoltage driving table, and the second overvoltage driving table are stored in the storage unit. The overvoltage driving unit, the data analysis unit, and the frame buffer unit are coupled to the timing control chip, where the timing control chip comprises a bus control unit coupled to the storage unit, and a receiving unit that receives display information of the pixel. A data latching unit, a backlight control unit, and a gamma correction unit are successively connected in series between the receiving unit and the overvoltage driving unit, and an output end of the overvoltage driving unit is successively connected in series with a timing control unit and a sending unit that is coupled to the data driving unit. The storage unit is an electrically erasable programmable read-only memory (EEPROM), and the bus control unit is coupled to the EEPROM through an inter-integrated circuit $I^2C$ bus.

The present disclosure provides a method for driving the LCD panel, where the LCD panel comprises the plurality of pixels, scan lines, data lines, the data driving unit that drives the data lines, the original overvoltage driving table, and the first overvoltage driving table. When an input signal driving the first overvoltage driving table is same as an input signal driving the original overvoltage driving table, partial voltages driving the data lines and corresponding to the first overvoltage driving table is greater than voltage driving the data lines and corresponding to the original overvoltage driving table. The data lines and the scan lines crisscross each other, each of the pixels belonging to a same column receives the data of the same data line, and each of the pixels comprises three sub-pixels controlled by three adjacent scan lines one by one. The method comprises:

A: reading gray level of two adjacent sub-pixels of the same data line in the same frame image, when the gray level difference between two adjacent sub-pixels of the same data line in the same frame image is greater than a first threshold value, the overvoltage driving unit drives the sub-pixel having a greater gray level in gray levels of two adjacent sub-pixels according to the first overvoltage driving table. The LCD panel further comprises a second overvoltage driving table. When an input signal driving the second overvoltage driving table is same as the input signal driving the original overvoltage driving table, partial voltages driving the data lines and corresponding to the second overvoltage driving table is less than the voltage of driving the data lines and corresponding to the original overvoltage driving table.

In the step A, when gray level difference between a next sub-pixel and a current sub-pixel of a same data line with the next sub-pixel is less than a preset second threshold value, the overvoltage driving unit drives the next sub-pixel according to the second overvoltage driving table.

The sub-pixel wing the great gray level receives the corresponding great driving voltage, when a next sub-pixel of the same data line with the sub-pixel having the great gray level is display in order to avoid the corresponding great driving voltage from causing over charging of the next sub-pixel of the same data line, the LCD panel uses the second overvoltage driving table having a smaller voltage than the original overvoltage driving table, which reduces charge difference between two adjacent sub-pixels having the great gray level, thereby reducing the color shift.

Furthermore, a range of the first threshold value is between three-fourths full gray scale and the full gray scale. A range of the second threshold value is between a quarter of full gray scale and zero.

Furthermore, the first threshold value is the full gray scale. The LCD panel further comprises the frame buffer unit that stores the gray level of each of the sub-pixels.

The LCD panel comprises the plurality of pixels, scan lines, data lines, and the data driving unit that drives the data lines. The data lines and the scan lines crisscross each other, each of the pixels belonging to a same column receives data of the same data line, and each of the pixels comprises three sub-pixels controlled by three adjacent scan lines one by one. The three adjacent scan lines are the first sub-pixel driven by the last-row of scan line, the second sub-pixel driven by the current-row of scan line, and the third sub-pixel driven by the next-row of scan line.

When the LCD panel displays a white image of full gray scale, driving voltage of the data driving unit that drives the first sub-pixel is regarded as a first driving voltage, and driving voltage of the data driving unit that drives the second sub-pixel being adjacent to the first sub-pixel is regarded as a second driving voltage.

When the LCD panel switches the white image of full gray scale to the first sub-pixel of gray level zero, and the second sub-pixel is the full gray scale, driving voltage of the data driving unit that drives the first sub-pixel is regarded as a third driving voltage, and driving voltage of the data driving unit that drives the second sub-pixel being adjacent to the first sub-pixel is regarded as a fourth driving voltage. The fourth driving voltage is greater than the second driving voltage.

When the LCD panel displays the white image of full gray scale, driving voltage of the data driving unit that drives the third sub-pixel being adjacent to the second sub-pixel is regarded as a fifth driving voltage. When the LCD panel switches the white image of the full gray scale to the first sub-pixel of gray level zero, and the second sub-pixel and the third sub-pixel are full gray scale, driving voltage of the data driving unit that drives the third sub-pixel is regarded as a sixth driving voltage. The sixth driving voltage is greater than the fifth driving voltage.

It should be understood that, when the gray level of the first sub-pixel is small, voltage of the second sub-pixel slowly increases because of signal delay of the data line, which causes undercharge of the second sub-pixel. However, voltage of the second sub-pixel is high, and voltage of the third sub-pixel is slightly affected, thus, the change of voltage of the data line corresponding to the third sub-pixel is small, which causes supersaturated charging of the third sub-pixel. Thus, the color shift is generated in an image of color mixing (as shown in FIG. 1). The present disclosure uses the first overvoltage driving table, when the input signal driving the first overvoltage driving table is same as the input signal driving the original overvoltage driving table, the partial voltages driving the data lines and corresponding to the first overvoltage driving table is greater than the voltage driving the data lines and corresponding to the original overvoltage driving table. When the gray level of the first sub-pixel is small, the overvoltage driving unit drives the second sub-pixel according to the first overvoltage driving table, thus, in the same time, the second sub-pixel charges enough, which reduces charge difference between the second sub-pixel and the third sub-pixel, thereby reducing the color shift.

DETAILED DESCRIPTION

Figure 1:
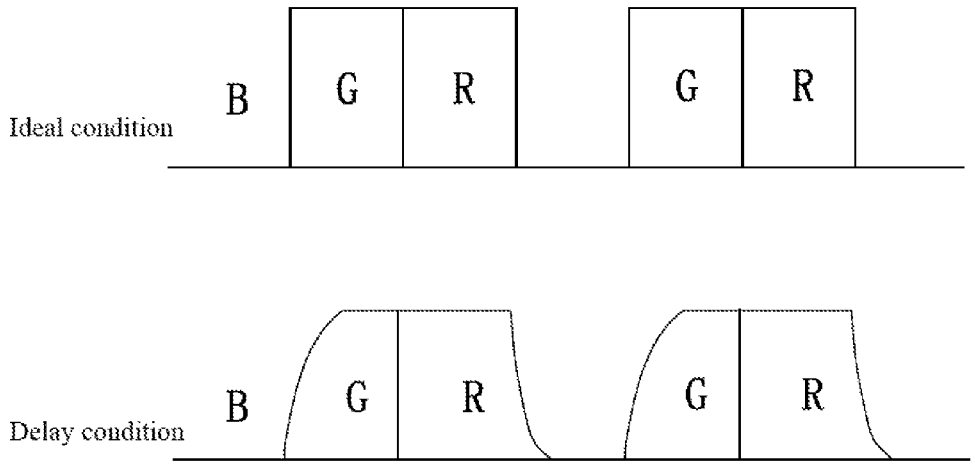
FIG. 1 (PRIOR ART)
FIG. 1 is a schematic diagram of a color shift of a typical liquid crystal display (LCD) panel.
Figure 2:
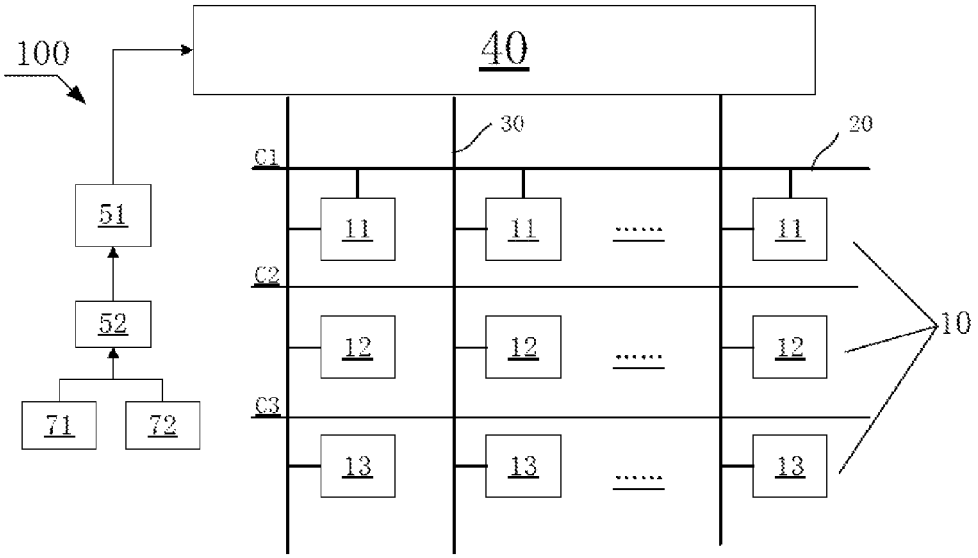
FIG. 2 is a schematic diagram of an LCD panel of the present disclosure.

The present disclosure provides a liquid crystal display (LCD) device comprising an LCD panel and a backlight unit. As shown in FIG. 2, the LCD panel comprises a plurality of pixels 10, scan lines 20, data lines 30, and a data driving unit 40 that drives the data lines 30. The data lines and the scan lines crisscross each other. Each of the pixels 10 belonging to a same column receives data of a same data line 30, and each of the pixels comprises three sub-pixels controlled by three adjacent scan lines one by one. The three sub-pixels are a first sub-pixel 11 driven by a last-row of scan line 20, a second sub-pixel 12 driven by a current-row of scan line 20, and a third sub-pixel 13 driven by a next-row of scan line 20. The LCD panel further comprises an overvoltage driving unit 51 coupled to the data driving unit 40, a data analysis unit 52 coupled to the overvoltage driving unit 51 and reading gray level of each of the sub-pixels, an original overvoltage driving table 71, and a first overvoltage driving table 72, where the original overvoltage driving table 71 and the first overvoltage driving table 72 are coupled to the data analysis unit 52. When an input signal driving the first overvoltage driving table is same as an input signal driving the original overvoltage driving table, namely gray level of same sub-pixel is same, partial voltages driving the data lines and corresponding to the first overvoltage driving table 72 is greater than voltage driving the data lines and corresponding to the original overvoltage driving table 71.

A gray level difference between two adjacent sub-pixels of the same data line in a same frame image is greater than a first threshold value. The overvoltage driving unit 51 drives the sub-pixel having a greater gray level according to the first overvoltage driving table 72. It is assumed that the gray level of the first sub-pixel 11 is less than the gray level of the second sub-pixel 12, and the second sub-pixel 12 displays after the first sub-pixel 11 displays, thus, the overvoltage driving unit 51 drives the second sub-pixel 12 according to the first overvoltage driving table 72.

It should be understood that, when the gray level of the first sub-pixel 11 is small, voltage of the second sub-pixel 12 slowly increases because of signal delay of the data line, which causes undercharge of the second sub-pixel. However, polarity of voltage of the third sub-pixel 13 is same as polarity of voltage of the second sub-pixel, and change of voltage of the data lines is small, which causes supersaturated charging of the third sub-pixel 13. Thus, a color shift is generated in an image of color mixing. The present disclosure uses the first overvoltage driving table 72, when the input signal driving the first overvoltage driving table 72 is same as the input signal driving the original overvoltage driving table 71, partial voltages driving the data lines and corresponding to the first overvoltage driving table 72 is greater than the voltage driving the data lines and corresponding to the original overvoltage driving table 71. When the gray level of the first sub-pixel 11 is small, the overvoltage driving unit 51 drives the second sub-pixel 12 according to the first overvoltage driving table 72, thus, in a same time, the second sub-pixel charges enough, which reduces charge difference between the second sub-pixel 12 and the third sub-pixel 13, thereby reducing the color shift.

The present disclosure will further be described in detail in accordance with the figures and the exemplary examples.

Example 1

Figure 3:
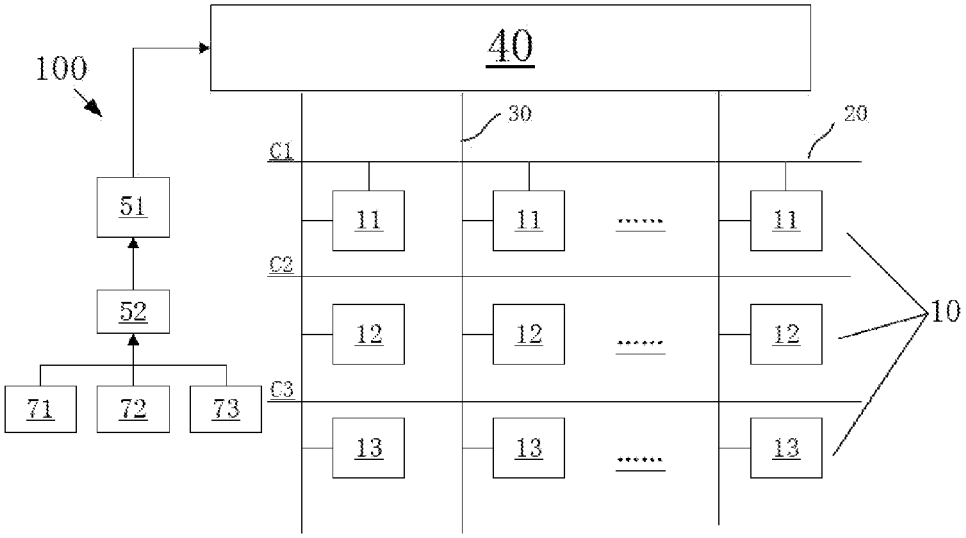
FIG. 3 is a schematic diagram of an LCD panel of a first example of the present disclosure.
Figure 4:
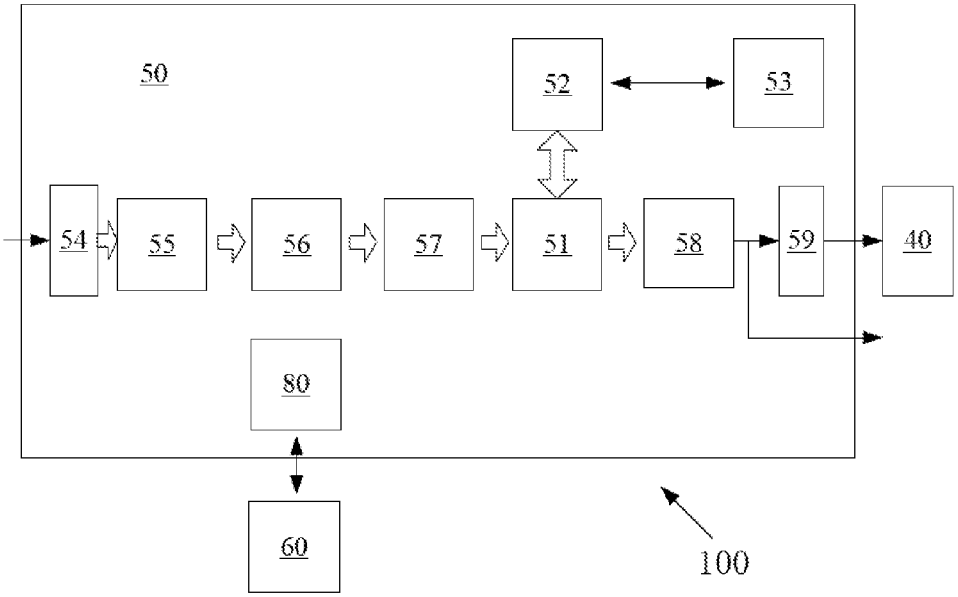
FIG. 4 is a schematic diagram of driving an LCD panel of a first example of the present disclosure.

As shown in FIG. 3 and FIG. 4, the LCD panel comprises the plurality of pixels 10, the scan lines 20, the data lines 30, and the data driving unit 40 that drives the data lines 30. The data lines and the scan lines crisscross each other. Each of the pixels 10 belonging to the same column receives the data of the same data line 30, and each of the pixels comprises three sub-pixels controlled by three adjacent scan lines one by one. The three sub-pixels are the first sub-pixel 11 driven by the last-row of scan line 20, the second sub-pixel 12 driven by the current-row of scan line 20, and the third sub-pixel 13 driven by the next-row of scan line 20. The LCD panel further comprises the overvoltage driving unit 51 coupled to the data driving unit 40, the data analysis unit 52 coupled to the owl voltage driving unit 51 and reading gray level of each of the sub-pixels, the original overvoltage driving table 71, the first overvoltage driving table 72, and a second overvoltage driving table 73, where the original overvoltage driving table 71, the first overvoltage driving table 72, and the second overvoltage driving table 73 are coupled to the data analysis unit 52. When the input signal driving the first overvoltage driving table is same as the input signal driving the original overvoltage driving table, and an input signal driving the second overvoltage driving table is same as the input signal driving the original overvoltage driving table, namely the gray level of the same sub-pixel is same, partial voltages driving the data lines and corresponding to the first overvoltage driving table 72 is greater than the voltage driving the data lines and corresponding to the original overvoltage driving table 71, and partial voltages driving the data lines and corresponding to the second overvoltage driving table 73 is less than the voltage driving the data lines and corresponding to the original overvoltage driving table 71.

The LCD panel further comprises a frame buffer unit 53 coupled to the data analysis unit 52. The data analysis unit 52 reads the gray level of each of the sub-pixels from the frame buffer unit 53. When the gray level difference between the first sub-pixels 11 and the second sub-pixels 12 exceeds the first threshold value, the overvoltage driving unit 51 drives the second sub-pixel 12 according to the first overvoltage driving table 72, and the overvoltage driving unit 51 drives the third sub-pixel 13 according to the second overvoltage driving table 73.

Generally, the first threshold value is a full gray scale, namely a greatest gray level. For example, the gray level of the first sub-pixels 11 is zero, and the gray level of the second sub-pixels 12 is the full gray scale (such as 255 gray scales or 128 gray scales), at this time, voltage difference between the first sub-pixels 11 and the second sub-pixels 12 is maximum, which has best effect for reducing the color shift.

The LCD panel further comprises a timing control chip 50 and a storage unit 60, where the original overvoltage driving table 71, the first overvoltage driving table 72, and the second overvoltage driving table 73 are arranged in the storage unit 60. The overvoltage driving unit 51, the data analysis unit 52, and the frame buffer unit 53 are coupled to the timing control chip 50, the timing control chip 50 further comprises a bus control unit 80 coupled to the storage unit 60, and a receiving unit 54 that receives display data of the pixel. A data latching unit 55, a backlight control unit 56, and a gamma correction unit 57 are successively connected in series between the receiving unit 54 and the overvoltage driving unit 51. An output end of the overvoltage driving unit 51 is successively connected in series with a timing control unit 58 and a sending unit 59 coupled to the data driving unit 40. It should be considered that the original overvoltage driving table 71, the first overvoltage driving table 72, and the second overvoltage driving table 73 can be arranged in the timing control chip 50, for example, the original overvoltage driving table 71, the first overvoltage driving table 72, and the second overvoltage driving table 73 are directly arranged in the data analysis unit 52 or the frame buffer unit 53. The storage unit 60 may use an electrically erasable programmable read-only memory (EEPROM), and the bus control unit 80 is coupled to the EEPROM through an inter-integrated circuit $I^2C$ bus.

Example 2

The present disclosure provides a method for driving the LCD panel, where the LCD panel comprises the plurality of the pixels 10, the scan lines 20, the data lines 30, and the data driving unit 40 that drives the data lines 30. The data lines and the scan lines crisscross each other. Each of the pixels 10 belonging to the same column receives the data of the same data line 30, and each of the pixels comprises three sub-pixels controlled by three adjacent scan lines one by one. The LCD panel further comprises the preset original overvoltage driving table 71 and the preset first overvoltage driving table 72. When the input signal driving the first overvoltage driving table is same as the input signal driving the original overvoltage driving table, namely the gray level of same sub-pixel is same, partial voltages driving the data lines and corresponding to the first overvoltage driving table 72 is greater than the voltage driving the data lines and corresponding to the original overvoltage driving table 71. The method comprises:

A: reading gray levels of two adjacent sub-pixels of the same data line in the same frame image, when gray level difference between two adjacent sub-pixels of the same data line in the same frame image is greater than the first threshold value, the overvoltage driving unit 51 drives the sub-pixel having the great gray level in gray levels of two adjacent sub-pixels according to the first overvoltage driving table 72.

The sub-pixel having the great gray level receives the corresponding great driving voltage, when a next sub-pixel of the same data line with the sub-pixel having the great gray level is display, in order to avoid the corresponding great driving voltage from causing over charging of the next sub-pixel of the same data line the LCD panel is further configured with the second overvoltage driving table 73 coupled to the data analysis unit. When the input signal driving the second overvoltage driving table is same as the input signal driving the original overvoltage driving table, partial voltages driving the data lines and corresponding to the second overvoltage driving table 73 is less than the voltage driving the data lines and corresponding to the original overvoltage driving table 71.

In the step A, if gray level difference between the sub-pixel having the greater gray level and the next sub-pixel of the same data line with the sub-pixel having the greater gray level is less than a preset second threshold value, the overvoltage driving unit 51 drives the next sub-pixel according to the second overvoltage driving table 73.

The second overvoltage driving table 73 is used to reduce the charge difference between two adjacent sub-pixels having the great gray level, thereby reducing the color shift.

Furthermore, a range of the first threshold value is between three-fourths full gray scale and the full gray scale, and a range of the second threshold value is between a quarter of full gray scale and zero.

Figure 5:
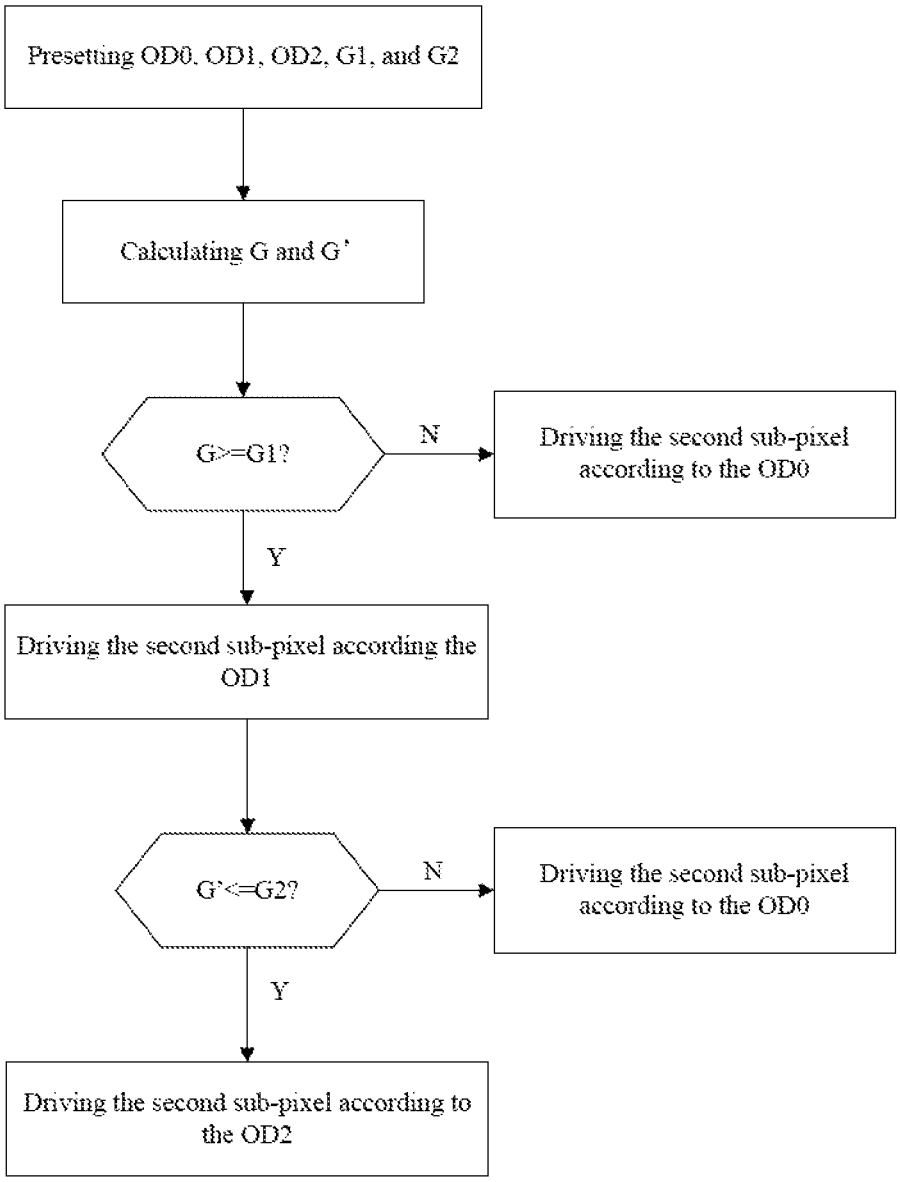
FIG. 5 is a flowchart of a method for driving an LCD panel of a second example of the present disclosure.

To be specific, as shown in FIG. 5, the original overvoltage driving table OD0, the first overvoltage driving table OD1, and the second overvoltage driving table OD2 are preset. Partial driving voltage corresponding to the first overvoltage driving table OD1 is greater than the driving voltage corresponding to the original overvoltage driving table OD0, partial driving voltage corresponding to the second overvoltage driving table OD2 is less than the driving voltage corresponding to the original overvoltage driving table OD0. The first threshold value G1 and the second threshold value G2 are set.

The gray level of the first 11 is read, if the gray level different G between the first sub-pixel 11 and the second sub-pixel 12 is greater than or equal to the first threshold value G1, the overvoltage driving unit drives the second sub-pixel 12 according to the first overvoltage driving table OD1. If the gray level different G between the first sub-pixel 11 and the second sub-pixel 12 is less than the first threshold value G1, the overvoltage driving unit drives the first sub-pixel 11 according to the original overvoltage driving table OD0. If the gay level different G' between the third sub-pixel 13 and the second sub-pixel 12 is less than the second threshold value G2, the overvoltage driving unit drives the third sub-pixel 13 according to the second overvoltage driving table OD2. If the gray level different G' between the third sub-pixel 13 and the second sub-pixel 12 is greater than or equal to the second threshold value G2, the overvoltage driving unit drives the second sub-pixel 12 according to the original overvoltage driving table OD0.

The fill gray scale may be regarded as the first threshold value G1 (such as 255 gray scales or 128 gray scales), at this time, the voltage different between the first sub-pixel 11 and the second sub-pixel 12 is maximum, which has best effect for reducing the color shift.

Figure 6:
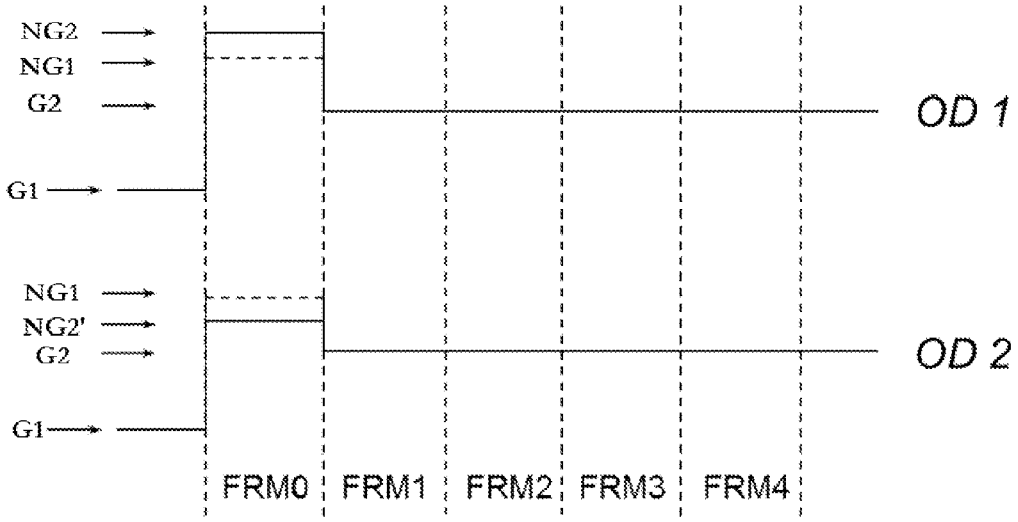
FIG. 6 is a schematic diagram of a driving waveform of an LCD panel of a second example of the present disclosure.

As shown in FIG. 6, if the gray level of the first sub-pixel 11 corresponding to the last-row of scan line is very low (such as 0), the second sub-pixel 12 corresponding to the current-row of scan line is driven according to the first overvoltage driving table OD1, and the third sub-pixel 13 corresponding to the next-row of scan line is driven according to the second overvoltage driving table OD2. Voltage corresponding to the second sub-pixel 12 in a previous-frame image is regarded as G1 and voltage corresponding to the second sub-pixel 12 in a next-frame image is regarded as G2. Generally, the second sub-pixel 12 in a current-frame image is driven by a driving voltage NG1 of the original overvoltage driving table OD0, where NG1>G2, after the first overvoltage driving table OD1 is used, the driving voltage of the second sub-pixel 12 in the current-flame image is the driving voltage NG2, where NG2>NG1>G2. After the second overvoltage driving table OD2 is used, the driving voltage of the third sub-pixel 13 in the current-frame image is the driving voltage NG2', where NG1>NG2'≥G2, or NG1>G2≥NG2'.

Figure 7:
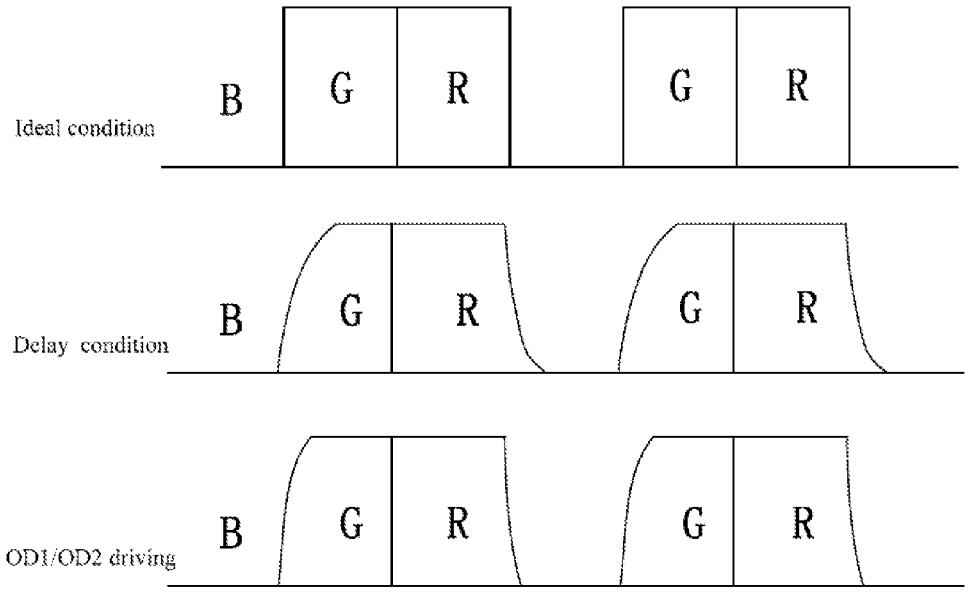
FIG. 7 is a schematic diagram of reducing a color shift of an LCD panel after using a method for driving the LCD panel of present disclosure.

Thus, in a driving method of line inversion or frame inversion in an image of two-color mixing, as shown in FIG. 7, if the gray level of the first sub-pixel is zero, the voltage of the second sub-pixel fast increases because the second sub-pixel uses a greater voltage than the first sub-pixel, and charge of the second sub-pixel is completely compensated, the third sub-pixel uses a small voltage, which balance charge of the second sub-pixel and the third sub-pixel, thereby effectively reducing the color shift.

The LCD panel comprises the frame buffer unit 53 that stores the gray level of each of the sub-pixels in the last-frame image and the current-frame image, thus, the gray level of each of the sub-pixels is read from the frame buffer unit 53 to determine whether the first overvoltage driving table and the second overvoltage driving table are used or not.

Example 3

Figure 8:
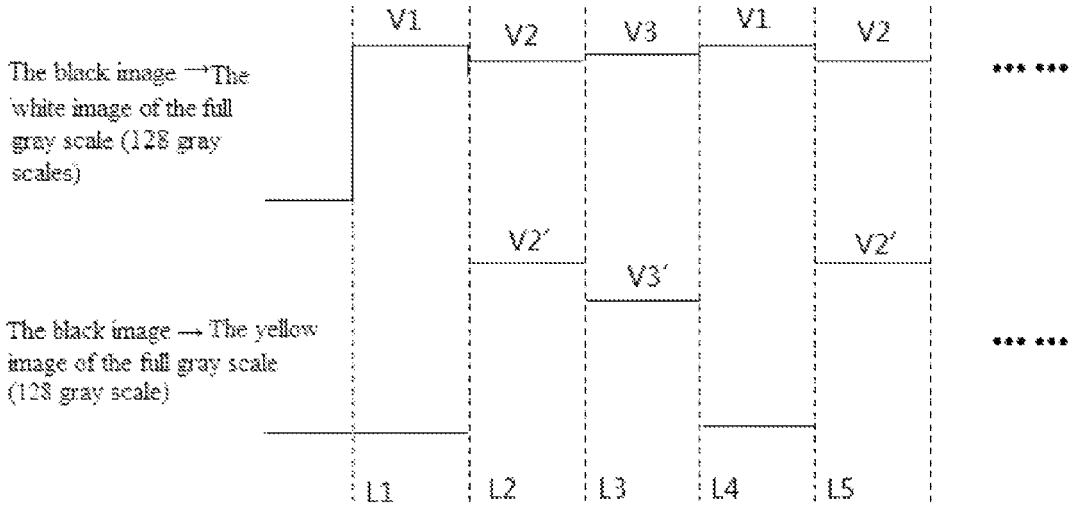
FIG. 8 is a schematic diagram of an LCD panel of a third example of the present disclosure.

As shown in FIG. 8, a third example provides the LCD panel, where the LCD panel comprises the plurality of pixels 10, the scan lines 20, the data fines 30, and the data driving unit 40 that drives the data lines 30. The data lines and the scan lines crisscross each other. Each of the pixels belonging to the same column receives the data of the same data line 30, and each of the pixels comprises three sub-pixels controlled by three adjacent scan lines one by one. The three sub-pixels are the first sub-pixel 11 driven by the last-row of scan line, the second sub-pixel 12 driven by the current-row of scan line, and the third sub-pixel 13 driven by the next-row of scan line.

When the LCD panel displays a white image of full gray scale, driving voltage of the data driving unit 40 that drives the first sub-pixel 11 is regarded as a first driving voltage, and driving voltage of the data driving unit 40 that drives the second sub-pixel 12 being adjacent to the first sub-pixel 11 is regarded as a second driving voltage.

When the LCD panel switches the white image of the full gray scale to the first sub-pixel 11 of gray level zero, and the second sub-pixel 12 is the full gray scale, driving voltage of the data driving unit 40 that drives the first sub-pixel 11 is regarded as a third driving voltage, and driving voltage of the data driving unit 40 that drives the second sub-pixel 12 being adjacent to the first sub-pixel 11 is regarded as a fourth driving voltage. The fourth driving voltage is greater than the second driving voltage.

Furthermore, when the LCD panel displays the white image of the fill gray scale, driving voltage of the data driving unit 40 that drives the third sub-pixel 13 being adjacent to the second sub-pixel 12 is regarded as a fifth driving voltage.

When the LCD panel switches the white image of the full gray scale to the first sub-pixel 11 of gray level zero, the second sub-pixel 12 and the third sub-pixel 13 are the full gray scale, driving voltage of the data driving unit 40 that drives the third sub-pixel 13 is regarded as a sixth driving voltage. The sixth driving voltage is less than the fifth driving voltage.

The method for driving the above-mentioned LCD panel comprises: (taking the full gray scale comprising 128 gray scales as an example)

A: switching a black image of the LCD panel to the white image of the full gray scale, when the first sub-pixel 11, the second sub-pixel 12, and the third sub-pixel 13 successively display, voltages corresponding to the data lines correspondingly connected with the first sub-pixel 11, the second sub-pixel 12, and the third sub-pixel 13 are detected, and are respectively regarded as V1 (the first driving voltage), V2 (the second driving voltage), and V3 (the fifth driving voltage).

B: switching the image of the LCD panel back the black image, and then switching the black image to a yellow image of the full gray scale, at that time, the gray level of the first sub-pixel 11 is zero, the gray level of the second sub-pixel 12 is 128, and the gray level of the third sub-pixel 13 is 128. When the first sub-pixel 11, the second sub-pixel 12, and the third sub-pixel 13 successively display, voltages corresponding to the data lines correspondingly connected with the first sub-pixel 11, the second sub-pixel 12, and the third sub-pixel 13 are detected, and are respectively regarded as V1' (the third driving voltage), V2' (the fourth driving voltage), and V3' (the sixth driving voltage):

If V2'>V2. V3'<V3, which verifies the LCD panel to use the present disclosure.

The present disclosure is described in detail in accordance with the above exemplary examples. However, this present disclosure is not limited to the exemplary examples. On the premise of keeping the conception and the scope of the present disclosure, all modifications, equivalent replacements and improvements, etc. should be considered to belong to the protection scope of the present disclosure.

The invention claimed is:

1. A liquid crystal display (LCD) panel, comprising:

a plurality of pixels;

scan lines;

data lines;

a data driving unit that drives the data lines;

an overvoltage driving unit coupled to the data driving unit;

a data analysis unit coupled to the overvoltage driving unit and reading a gray level of each of a plurality of sub-pixels;

an original overvoltage driving table; and a first overvoltage driving table;

wherein the data lines and the scan lines crisscross each other, each of the pixels belonging to a same column receives data of a same data line, and each of the pixels comprises three sub-pixels controlled by three adjacent scan lines one by one;

wherein the original overvoltage driving table and the first overvoltage driving table are coupled to the data analysis unit; when an input signal driving the first overvoltage driving table is same as an input signal driving the original overvoltage driving table, partial voltages driving the data lines and corresponding to the first overvoltage driving table is greater than voltage driving the data lines and corresponding to the original overvoltage driving table;

in a same frame image, when gray level of a current sub-pixel is greater than gray level of a previous sub-pixel of a same data line with the current sub-pixel, and gray level difference between the current sub-pixel and the previous sub-pixel is greater than a first threshold value, the overvoltage driving unit drives the current sub-pixel according to the first overvoltage driving table, wherein the LCD panel further comprises a second overvoltage driving table coupled to the data analysis unit; when an input signal driving the second overvoltage driving table is same as the input signal driving the original overvoltage driving table, partial voltages driving the data lines and corresponding to the second overvoltage driving table is less than the voltage driving the data lines and corresponding to the original overvoltage driving table;

in the same frame image, when gray level difference between the current sub-pixel and the previous sub-pixel of the same data line with the current sub-pixel is less than a second threshold value; the overvoltage driving unit drives the current sub-pixel according to the second overvoltage driving table, wherein a range of the first threshold value is between three-fourths full gray scale and the full gray scale;

a frame buffer unit, a timing control chip, and a storage unit; the gray level of each of the sub-pixels is stored in the frame buffer unit; the original overvoltage driving table, the first overvoltage driving table, and a second overvoltage driving table are stored in the storage unit; the overvoltage driving unit, the data analysis unit, and the frame buffer unit are coupled to the timing control chip;

wherein the timing control chip comprises a bus control unit coupled to the storage unit, and a receiving unit that receives display information of the pixel; a data latching unit, a backlight control unit, and a gamma correction unit are successively connected in series between the receiving unit and the overvoltage driving unit; an output end of the overvoltage driving unit is successively connected in series with a timing control unit and a sending unit that is coupled to the data driving unit; the storage unit is an electrically erasable programmable read-only memory (EEPROM), and the bus control unit is coupled to the EEPROM through a inter-integrated circuit $I^2C$ bus.

* * * * *